US006837981B2

(12) United States Patent
Horsthemke

(10) Patent No.: US 6,837,981 B2
(45) Date of Patent: Jan. 4, 2005

(54) CHROMIUM ALLOY COATING AND A METHOD AND ELECTROLYTE FOR THE DEPOSITION THEREOF

(75) Inventor: Helmut Horsthemke, Düsseldorf (DE)

(73) Assignee: Enthone Inc., West Haven, CT (US)

( * ) Notice: Subject to any disclaimer, the term of this patent is extended or adjusted under 35 U.S.C. 154(b) by 175 days.

(21) Appl. No.: 10/169,959

(22) PCT Filed: Nov. 3, 2001

(86) PCT No.: PCT/EP01/12747

§ 371 (c)(1),
(2), (4) Date: Oct. 3, 2002

(87) PCT Pub. No.: WO02/38835

PCT Pub. Date: May 16, 2002

(65) Prior Publication Data

US 2003/0121794 A1 Jul. 3, 2003

(30) Foreign Application Priority Data

Nov. 11, 2000 (EP) ..... 00124672

(51) Int. Cl.[7] ..... C25D 3/56
(52) U.S. Cl. ..... 205/243; 252/500.1
(58) Field of Search ..... 204/243; 252/500.1

(56) References Cited

U.S. PATENT DOCUMENTS 3,745,097 A 7/1973 Chessin et al.
3,954,574 A * 5/1976 Gyllenspetz et al. ..... 205/243
4,392,922 A * 7/1983 Tomaszewski ..... 205/101
4,477,315 A * 10/1984 Tomaszewski ..... 205/48
4,588,481 A 5/1986 Chessin et al.
5,176,813 A 1/1993 Newby
5,196,108 A 3/1993 Wilmeth et al.

FOREIGN PATENT DOCUMENTS

CS 214 553 5/1982
SU 834 264 5/1981

* cited by examiner

*Primary Examiner*—Donald R. Valentine
(74) *Attorney, Agent, or Firm*—Senniger Powers

(57) ABSTRACT

The invention relates to a method for the electrolytic coating of materials, in particular metallic materials, whereby a chromium alloy is deposited from an electrolyte, comprising at least chromic acid, sulphuric acid, an isopolyanion-forming metal, a short-chain aliphatic sulphonic acid, the salts and/or halo-derivatives thereof and fluorides. According to the invention, an alloy can be deposited, which can comprise a high proportion of isopolyanion-forming metal as a result of the combined addition of the short-chain aliphatic sulphonic acid with the fluorides and is nevertheless smooth and lustrous. In comparison with the alloy coatings known in the state of the art, in particular chrome/molybdenum alloys the above is a definite advantage. Furthermore, the presence of fluorides in particular leads to the above deposited coatings having a significantly higher hardness.

47 Claims, No Drawings

CHROMIUM ALLOY COATING AND A METHOD AND ELECTROLYTE FOR THE DEPOSITION THEREOF

BACKGROUND OF THE INVENTION

Chromium has long been used in industry for surface finishing. Applications range from thin layers for decorative purposes up to the formation of hard chromium layers, which have greater layer thickness. With modern hard chrome plating high hardness and wear resistance, resistance to chemical effects, corrosion resistance and high temperature resistance are desirable advantages.

Most decorative chrome plating and almost all hard chrome plating is carried out with $CrO_3$ as electrolyte. The disadvantages that are connected with this, such as low current efficiencies while simultaneously having high current densities, high sensitivity to deposition conditions with low throwing power, and the need to use catalysts are taken as trade-offs because of the excellent layer properties of chromium.

The chromium electrolytes that are used are ones used with fluoride-containing catalysts, the so-called mixed acid electrolytes, as well as ones with fluoride-free catalysts. The mixed acid electrolytes were gradually replaced by the fluoride-free catalysts because working with such electrolytes required considerable expenses for analytical supervision and process control and, moreover, the base material was etched, and research was always being carried out to increase the current efficiency with these fluoride-free catalysts. The current efficiency of the chromium electrolytes is dependent on the electrolyte composition and the process that is used to a much greater degree than with other metal-depositing electrolytes. For this reason there have continuously been attempts to increase the current efficiency in chrome plating. For example, DE Patent 34 02 554 discloses the use of an organic compound as an agent to increase the current yield in the electrolytic deposition of hard chromium. In this case the use of a saturated aliphatic sulfonic acid or sulfonic acid derivative is disclosed as the organic compound. Also, U.S. Pat. No. 4,588,481 and U.S. Pat. No. 5,176,813 disclose the use of such substances for purposes of increasing current efficiencies. In addition, it is known according to the prior art from U.S. Pat. No. 3,745,097 that the presence of alkylsulfonic acids in an electrolyte leads to iridescent effects on the substantially glossy chromium coatings, through which extraordinarily decorative coatings are deposited.

In particular, the known tendency of chromium layers to form micro-cracks, which leads to low corrosion resistance, has lead to a search for chromium alloys that improve the known advantages while remedying the known disadvantages. The deposition of alloys containing molybdenum or vanadium in addition to chromium is described in relevant publications. In particular, attempts were made to improve the corrosion, wear and heat resistance and hardness through chromium-molybdenum alloys. However, tests showed that it turned out to be difficult to reproduce the published processes. Moreover, the known methods for producing a chromium-molybdenum alloy are characterized by extremely low current efficiency, due to which the known methods were not economical and not usable in the field of large-scale electroplating.

The methods known in the prior art lead only to dull chromium-molybdenum alloys which are incomparably less attractive when compared to the known pure chromium layers. In addition, there is a need to develop a method that is less affected by operating conditions in order to guarantee constant quality with low control costs. In addition, there is a need to increase the hardness of the coatings that form.

SUMMARY OF THE INVENTION

Based on the known prior art, this invention is therefore based on the task of making available for producing a chromium alloy that guarantees the production of a technically usable layer. In addition, with the invention an electrolyte for conducting the method is intended to be proposed.

This task is solved by a method for electrolytic coating of workpieces, especially metallic workpieces, where a chromium alloy is deposited from an electrolyte that contains at least chromic acid, sulfuric acid, a metal that forms isopolyanions, a short-chain aliphatic sulfonic acid, its salts and/or its halogen derivatives and fluorides. In addition, in order to solve the task, an electrolyte for galvanic deposition of a chromium alloy that contains at least chromic acid, sulfuric acid, and isopolyanion-forming metal, a short-chain aliphatic sulfonic acid, its salts and/or its halogen derivatives and fluorides is made available with the invention.

DETAILED DESCRIPTION OF PREFERRED EMBODIMENTS

According to a first approach to the solution it is proposed by the invention to deposit a chromium alloy from an electrolyte that contains, besides chromic acid and sulfuric acid, a metal that forms isopolyanions such as molybdenum, vanadium, tungsten or niobium. The isopolyanion-forming metals are preferably added in the form of an acid. The use of molybdenum, which can be added to the electrolyte in the form of molybdic acid or molybdic salts, proved to be particularly advantageous.

Alloys of chromium and an isopolyanion-forming metal and especially chromium-molybdenum alloys, however, have a dull, gray appearance. The dull appearance and extremely costly process conduct as well as low current efficiencies contrast with the advantage of a higher corrosion resistance, for example. Moreover, the composition of the thus-deposited layers is highly affected by operating conditions and for this reason is less suitable for industrial use.

It turned out that through the addition of a short-chain aliphatic sulfonic acid, its salts and/or its derivatives to an electrolyte that contains, besides chromic acid, sulfuric acid and at least one polyanion forming metal, one arrives at the deposition of smooth glossy layers of definite composition. The addition of a short-chain aliphatic sulfonic acid, its salts and/or its derivatives also causes the deposition of chromium alloy layers of specific composition that is constant over a broad range of operating conditions, and the sensitivity of the electrolyte is reduced.

Also, the addition of a short-chain aliphatic sulfonic acid, its salts and/or its derivatives makes it possible to reduce the chromic acid content. For constant isopolyanion content the buildup rate of the isopolyanion-forming metal will be higher, the lower the concentration of chromic acid in the electrolyte is. Surprisingly, it turned out that through the addition of a short-chain aliphatic sulfonic acid, its salts and/or its derivatives to an electrolyte solution that contains sulfuric acid and at least one isopolyanion-forming metal in addition to chromic acid makes it possible to reduce the concentration of chromic acid in the electrolyte and thus the rate of incorporation of the isopolyanion-forming metal into the alloy can be increased. It becomes advantageously possible to operate with low chromic acid concentrations relative to the concentration of the isopolyanion-forming metal. For this reason relatively less chromic acid can be used, which also has the advantageous result of saving costs, since this results in a reduction of the amount of pollutants.

The reduction of the chromic acid content and thus the possibility of increasing the incorporation rate of the isopolyanion-forming metal into the alloy is, on the one hand, advantageous for some properties of coatings, such as their corrosion resistance. However, it has the disadvantage that the high amount increases the roughness of the deposited materials again and the layers become unsightly and thus less usable. They are dull and tend to have poor adhesion.

It now surprisingly turned out that the addition of fluorides causes considerable improvements in the precipitated layer. These improvements appear in particular when the chromic acid content relative to the concentration of the isopolyanion-forming metal is reduced. The term "fluoride" includes both simple and complex fluorides. The addition of fluorides advantageously causes the deposited layers to have a smooth surface and high gloss and to be characterized by good adhesion. Industrially usable layers are deposited. Through the addition of small amounts of fluorides it is also possible to deposit chromium alloys that have clearly higher hardness.

The method in accordance with the invention makes it possible to ensure the generation of an industrially usable chromium alloy layer with constant composition that is characterized by decorative gloss, smooth surface and good adhesion properties. The combined addition of a short-chain aliphatic sulfonic acid and an isopolyanion-forming metal as well as fluorides thus surprisingly leads to an improved alloy deposit. The sulfonic acid addition makes it possible to make a relative reduction of the chromic acid concentration in the electrolyte, which leads to a higher rate of incorporation of the isopolyanion-forming metal into the alloy. The addition of a small amount of fluoride causes the adhesion, gloss and smoothness of the layer to increase noticeably. In this way the incorporation rate of the isopolyanion-forming metal into the chromium alloy can be increased and nevertheless industrially usable layers are deposited.

The layer deposited from the electrolyte in accordance with the invention by the method in accordance with the invention has advantageous properties, which distinguish it both from pure chromium coatings and the chromium alloys known in the prior art. This shows up clearly in the case of chromium-molybdenum alloys. The method in accordance with the invention enables the industrial use of the chromium-molybdenum alloys that are dull, gray and otherwise too highly affected by the operating conditions. This also is an advantage over pure chromium coatings, which also have high sensitivity to deposition conditions. Through this the method in accordance with the invention is economical to a particular degree, since the product quality is more constant and thus fewer rejects are formed.

The use of saturated aliphatic sulfonic acids with a maximum of two carbon atoms and a maximum of six sulfonic acid groups or their salts or halogen derivatives proved to be particularly advantageous. Thus, the use of a saturated aliphatic sulfonic acid or its salts or halogen derivatives leads not only to an increase of the current efficiency, but also to the above noted surprising effect on the alloy composition and tolerance of the alloy deposited in accordance with the invention to operating conditions. This effect is completely new and the method in accordance with the invention thus offers for the first time the possibility of producing less costly, for example also glossy, chromium alloys that have many of the advantageous properties of pure chromium layers and have the additional properties that are favored through the alloy, which overall leads to a usable layer that is superior in many regards both to the pure chromium layers and to the known chromium alloys, for example the chromium-molybdenum alloy layers.

For example, chromium-molybdenum layers that are deposited from a sulfuric acid electrolyte, while having low crack density, have broad cracks that can reach from the surface to the base metal, which degrades the corrosion resistance. The method in accordance with the invention overcomes this disadvantage through the addition of a short-chain aliphatic sulfonic acid, its salts and/or its derivatives, since in this way the crack density clearly increases. The cracks in the layers deposited with the method in accordance with the invention are therefore very fine and no longer extend to the base material. This has an extraordinarily advantageous effect on the corrosion resistance and produces a clear advantage for the layers deposited with the method in accordance with the invention over, for example, the known chromium-molybdenum layers. Thus, tests show that pure chromium layers allow clearly higher anode currents than the alloy layers produced with the method in accordance with the invention. In addition, it turns out that when molybdenum compounds, for example, are used together with organic compounds, layers are deposited that have clearly lower anode corrosion currents when compared to the pure chromium layers. In this way it turns out that the layers deposited in accordance with the invention have clearly higher corrosion resistance than pure hard chromium layers. This clear difference additionally results in the layers produced with the method in accordance with the invention having better chemical resistance to chlorides.

In addition, the layers deposited with the method in accordance with the invention are advantageously characterized by high hardness and high wear resistance. The hardness of the coating produced with the method in accordance with the invention can have values over 1050 HV 0.1 because of the fluorides contained in the electrolyte. Hardnesses of 1300 HV 0.1 and higher were detected in tests.

Depending on the desired rate of incorporation of the isopolyanion-forming metal, the electrolyte contains chromic acid in an amount from 100 g/L to 400 g/L. In addition, the electrolyte contains the catalyzing sulfuric acid in an amount from 1 g/L to 6 g/L, but advantageously 2 g/L. It is especially advantageous if one operates with a ratio of chromium to sulfuric acid of 100:1.

The short-chain aliphatic sulfonic acids, their salts and/or derivatives are added to the electrolyte in a concentration over 0.1 g/L, and an amount of 2 g/L proved to be especially advantageous. The addition of short-chain aliphatic sulfonic acid, its salts and/or derivatives also makes it possible to operate with lower chromic acid concentrations in the electrolyte in comparison with the concentration of the isopolyanion-forming metal.

The relevant isopolyanion-forming metal is added to the electrolyte in amounts from about 1 g/L up to the limit of solubility. The solubility limit varies in dependence on the chromic acid content.

According to one embodiment, molybdenum in the form of molybdic acid (ammonium molybdate) or an alkali molybdate is added to the electrolyte as the isopolyanion-forming metal. The ratio of chromic acid to the molybdenum compound is preferably about 2:1. The addition of 50–90 g/L molybdic acid proved to be especially advantageous.

According to another embodiment, vanadium is added to the electrolyte as polyanion-forming metal. Preferably, ammonium metavanadate, vanadic acid or vanadium pentoxide is used to generate a vanadium-containing electrolyte. The ratio of chromic acid to the vanadium compound is preferably about 5:1.

According to another embodiment of the method in accordance with the invention, niobium is added to the electrolyte as isopolyanion-forming metal. Niobium is chiefly added to the electrolyte in the form of niobic acid. The ratio of chromic acid to the niobium compound is about 50:1.

According to another embodiment, tungsten is added to the electrolyte as isopolyanion-forming metal. Tungsten is preferably added to the electrolyte in the form of an alkali tungstate. The ratio of chromic acid to the tungsten compound is about 40:1.

Even small amounts of fluorides in the electrolyte are sufficient to produce the extraordinary and surprising effects. The fluorides can be added to the electrolyte as acid or alkali salts. In the same way it is also possible to use complex fluorides. These compounds are added in amounts from 30 to 800 mg/L. These amounts have the above-described positive effects on the hardness, gloss, roughness and adhesion of the layers as a consequence. Preferably, fluorides are added to the electrolyte in amounts from 30 to 300 mg/L. In this concentration range the electrolyte works in an advantageous way so as to be practically non-etching, so that the base material to be coated is not attacked.

The method in accordance with the invention advantageously makes it possible to adjust the operating parameters electrolyte composition, electrolyte temperature and/or current density in dependence on the desired rate of incorporation of the isopolyanion-forming metal and the appearance of the layer. In this way a coating in accordance with the invention can be targeted to the relevant requirements.

The incorporation rates into the alloy, layer are about 0.01 to 0.05% for vanadium, about 0.01 to 0.5% for niobium, about 0.1 to 10% for molybdenum and about 0.01 to 0.5% for tungsten.

To deposit the chromium alloy, the electrolyte is connected to an external current source. The method in accordance with the invention advantageously allows a wide working range of current densities while ensuring a bright dull to very glossy layer deposit. The current can be supplied at a current density in the range from 5 A/dm$^2$ up to at least 200 A/dm$^2$, so that even a high speed chrome plating is possible without any problem.

The method in accordance with the invention advantageously enables a reliably adherent, corrosion resistant and glossy layer to be deposited at a high cathode current efficiency. Here one preferably operates at a cathode efficiency of at least 15%. A coating that is formed in a current density operating range of 20–50 A/dm$^2$ proved to be especially advantageous. Through advantageous choice of the current density, it is also possible to affect the appearance of the deposited alloys.

The invention is to be illustrated by means of some examples, which solely serve for illustration.

1. Chromium-Molybdenum Layers

EXAMPLE A

A corrosion resistant chromium-molybdenum layer is deposited onto a steel body at 55° C. and cathode density of 58 A/dm$^2$ in an electrolyte containing 180 g/L chromic acid ($CrO_3$), 90 g/L molybdic acid (commercial grade, about 85% $MoO_3$) and 1% sulfuric acid, with respect to the chromic acid content, with the addition of 2.1 g/L methanesulfonic acid. The hardness of the coating that forms is under 1060 HV 0.1. The current efficiency is 15 to 16%.

If fluorides are added to this electrolyte in a concentration of 280 mg/L, a corrosion resistant and industrially usable alloy layer that has a hardness of 1300 HV 0.1 is deposited under the same operating conditions. The current efficiencies again lie in the range of about 16%. The alloy layers that can be deposited with the method in accordance with the invention from the electrolyte in accordance with the invention have a hardness that is clearly higher than the hardnesses that can be achieved with the traditional methods and that is due to the addition of the fluorides. If the cathode current density is reduced, the appearance of the deposited alloy layer changes. At a current density of 30 A/dm$^2$ the appearance of the deposited layers is clearly improved.

EXAMPLE B

A chromium-molybdenum alloy layer is deposited onto a steel body at a current density of 50 A/dm$^2$ and a temperature of 55° C. in an electrolyte containing 200 g/L chromic acid, 60 g/L molybdic acid (commercial grade, about 85% $MoO_3$) and 1% sulfuric acid with respect to the chromic acid content, with the addition of 2.1 g/L methanesulfonic acid. The deposited layer is dull and has a hardness of 945 HV 0.1.

After adding 280 mg/L fluoride in the form of fluorocyclic acid a pure glossy alloy layer with a hardness of about 1050 HV 0.1 is deposited.

2. Chromium-Vanadium Layers

A body of steel is platted at 55° C. and at a current density of 50 A/dm$^2$ after adding 2.1 g methanesulfonic acid in an electrolyte containing 200 g/L chromic acid ($CrO_3$), 35.5 g ammonium metavanadate and 1% sulfuric acid, with respect to the chromic acid content. At a current efficiency of 22.5% the deposited layer has a dull appearance. A highly glossy alloy layer is deposited after adding 280 mg/L fluoride as fluocyclic acid. The current efficiency is 22.8%.

These embodiment examples serve to illustrate the invention and are not limiting. The added amounts of the individual catalysts can vary and are dependent on the bath composition and the deposition conditions.

All metal workpieces can be coated with a chromium alloy with the method described in accordance with the invention. In particular, the use of molybdenum as isopolyanion-forming metal is advantageous. The chromium-molybdenum alloy layers deposited by the method in accordance with the invention are characterized in particular by their smooth, bright dull to glossy appearance compared to traditional chromium-molybdenum alloys, and by their better corrosion resistance, especially their chemical resistance to chlorides, when compared to pure chromium layers. In addition, layers are deposited that can have considerably higher hardness of 1300 HV 0.1 and higher because of the fluorides.

What is claimed:

1. A method for electrolytically coating a workpiece comprising depositing a chromium alloy from an electrolyte comprising chromic acid, sulfuric acid, an isopolyanion-forming metal compound wherein the isopolyanion-forming metal is selected from the group consisting of Mo, V, W, and Nb, a fluoride, and a compound selected from the group consisting of a short-chain aliphatic sulfonic acid, a salt thereof, and a halogen derivative thereof.

2. The method according to claim 1, wherein the electrolyte has a concentration of the isopolyanion-forming metal compound of at least about 1 g/L.

3. The method according to claim 1, wherein the electrolyte comprises chromic acid and a molybdenum compound in a weight ratio of about 2:1.

4. The method according to claim 1 Wherein the electrolyte comprises chromic acid and a vanadium compound in a weight ratio of about 5:1.

5. The method according to claim 1 wherein the electrolyte comprises chromic acid and a niobium compound in a weight ratio of about 50:1.

6. The method according to claim 1 wherein the electrolyte comprises chromic acid and a tungsten compound in a weight ratio of about 40:1.

7. The method according to claim 1 wherein the electrolyte comprises a molybdenum compound selected from the group consisting of molybdic acid and an alkali molybdate.

8. The method according to claim 7 wherein the electrolyte has a molybdic acid concentration between about 50 g/L and about 90 g/L.

9. The method according to claim 1 wherein the electrolyte comprises a vanadium compound selected from the group consisting of ammonium metavanadate, vanadic acid, and vanadium pentoxide.

10. The method according to claim 1 wherein the electrolyte comprises a niobium compound comprising niobic acid.

11. The method according to claim 1 Wherein the electrolyte comprises a tungsten compound comprising an alkali tungstenate.

12. The method according to claim 1 wherein the electrolyte has a concentration of short-chain aliphatic sulfonic acids, salts thereof, and halogen derivatives thereof of at least about 0.1 g/L.

13. The method according to claim 12 Wherein the concentration of short-chain aliphatic sulfonic acids, salts thereof, and halogen derivatives thereof is between about 0.1 g/L and about 10 g/L.

14. The method according to claim 12 wherein the concentration of short-chain aliphatic sulfonic acids, salts thereof, and halogen derivatives thereof is about 2 g/L.

15. The method according to claim 1 wherein the electrolyte has a sulfuric acid concentration between about 1 g/L and about 6 g/L.

16. The method according to claim 15 wherein the sulfuric acid concentration is about 2 g/L.

17. The method according to claim 1 wherein the electrolyte comprises chromic acid and sulfuric acid in a weight ratio of about 100:1.

18. The method according to claim 1 wherein the electrolyte has a chromic acid concentration between about 100 g/L and about 400 g/L.

19. The method according to claim 1 wherein the electrolyte has a fluoride concentration between about 30 mg/L and about 800 mg/L.

20. The method according to claim 19 Wherein the fluoride concentration is between about 30 mg/L and about 300 mg/L.

21. The method according to claim 1 wherein the chromium alloy is deposited at a current density between about 20 $A/dm^2$ and about 100 $A/dm^2$.

22. A chromium alloy layer produced by the method according to claim 1, the layer comprising chromium and an isopolyanion-forming metal and having a hardness of at least about 1050 HV 0.1.

23. The chromium alloy layer according to claim 22, wherein the layer is glossy.

24. An electrolyte for electrolytic deposition of a chromium alloy, the electrolyte comprising chromic acid, sulfuric acid, an isopolyanion-forming metal compound wherein the isopolyanion-forming metal is selected from the group consisting of Mo, V, W, and Nb , a fluoride, and a compound selected from the group consisting of a short-chain aliphatic sulfonic acid, a salt thereof, and a halogen derivative thereof.

25. The electrolyte according to claim 24 wherein the isopolyanion-forming metal is in the form of an acid.

26. The electrolyte according to claim 24 wherein the electrolyte has a concentration of the isopolyanion-forming metal compound of at least about 1 g/L.

27. The electrolyte according to claim 24 wherein the electrolyte comprises chromic acid and a molybdenum compound in a weight ratio of about 2:1.

28. The electrolyte according to claim 28 Wherein the electrolyte comprises chromic acid and a vanadium compound in a weight ratio of about 5:1.

29. The electrolyte according to claim 24 Wherein the electrolyte comprises chromic acid and a niobium compound in a weight ratio of about 50:1.

30. The electrolyte according to claim 24 wherein the electrolyte comprises chromic acid and a tungsten compound in a weight ratio of about 40:1.

31. The electrolyte according to claim 24 wherein the electrolyte comprises a molybdenum compound selected from the group consisting of molybdic acid and an alkali molybdate.

32. The electrolyte according to claim 31 wherein the electrolyte has a molybdic acid concentration between about 50 g/L and about 90 g/L.

33. The electrolyte according to claim 24 wherein the electrolyte comprises a vanadium compound selected from the group consisting of ammonium metavanadate, vanadic acid, and vanadium pentoxide.

34. The electrolyte according to claim 24 wherein the electrolyte comprises a niobium compound comprising niobic acid.

35. The electrolyte according to claim 34 wherein the concentration of short-chain aliphatic sulfonic acids, salts thereof, and halogen derivatives thereof is between about 0.1 g/L and about 10 g/L.

36. The electrolyte according to claim 34 wherein the concentration of short-chain aliphatic sulfonic acids, salts thereof, and halogen derivatives thereof is about 2 g/L.

37. The electrolyte according to claim 24 wherein the electrolyte comprises a tungsten compound comprising an alkali tungstenate.

38. The electrolyte according to claim 24 wherein the electrolyte has a concentration of short-chain aliphatic sulfonic acids, salts thereof, and halogen derivatives thereof of at least about 0.1 g/L.

39. The electrolyte according to claim 24 wherein the electrolyte has a sulfuric acid concentration between about 1 g/L and about 6 g/L.

40. The electrolyte according to claim 39 wherein the sulfuric acid concentration is about 2 g/L.

41. The electrolyte according to claim 24 wherein the electrolyte comprises chromic acid and sulfuric acid in a weight ratio of about 100:1.

42. The electrolyte according to claim 24 wherein the electrolyte has a chromic acid concentration between about 100 g/L and about 400 g/L.

43. The electrolyte according to claim 24 wherein the electrolyte has a fluoride concentration between about 30 mg/L and about 800 mg/L.

44. The electrolyte according to claim 43 wherein the fluoride concentration is between about 30 mg/L and about 300 mg/L.

45. The electrolyte according to claim 24 wherein the electrolyte is capable of depositing an alloy of chromium and the isopolyanion-forming metal in an electrolytic coating process, the alloy having a hardness of at least about 1050 HV 0.1.

46. A method for electrolytically coating a workpiece comprising depositing a chromium alloy from an electrolyte comprising chromic acid in a concentration between about 100 g/L and about 400 g/L, sulfuric acid, an isopolyanion-forming metal compound, a fluoride, and a compound selected from the group consisting of a short-chain aliphatic sulfonic acid, a salt thereof, and a halogen derivative thereof.

47. An electrolyte for electrolytic deposition of a chromium alloy, the electrolyte comprising chromic acid in a concentration between about 100 g/L and about 400 g/L, sulfuric acid, an isopolyanion-forming metal compound, a fluoride, and a compound selected from the group consisting of a short-chain aliphatic sulfonic acid, a salt thereof, and a halogen derivative thereof.

* * * * *